US011445285B2

(12) United States Patent
Zhao

(10) Patent No.: US 11,445,285 B2
(45) Date of Patent: Sep. 13, 2022

(54) INTERACTIVE CONTROL METHOD AND DEVICE OF AN EARPHONE CASE, EARPHONE CASE AND STORAGE MEDIUM

(71) Applicant: GOERTEK INC., Shandong (CN)

(72) Inventor: Jifu Zhao, Shandong (CN)

(73) Assignee: GOERTEK INC., Shandong (CN)

( * ) Notice: Subject to any disclaimer, the term of this patent is extended or adjusted under 35 U.S.C. 154(b) by 0 days.

(21) Appl. No.: 17/302,280

(22) Filed: Apr. 29, 2021

(65) Prior Publication Data

US 2021/0250677 A1 Aug. 12, 2021

Related U.S. Application Data

(63) Continuation of application No. PCT/CN2018/125265, filed on Dec. 29, 2018.

(30) Foreign Application Priority Data

Oct. 29, 2018 (CN) ..... 201811270481.2
Nov. 9, 2018 (CN) ..... 201811332524.5

(51) Int. Cl.
*H04R 1/10* (2006.01)

(52) U.S. Cl.
CPC ..... *H04R 1/1041* (2013.01); *H04R 1/1016* (2013.01); *H04R 1/1025* (2013.01);
(Continued)

(58) Field of Classification Search
CPC .. H04R 1/1041; H04R 1/1016; H04R 1/1025; H04R 2201/10; H04R 2420/07; H04R 2499/11
See application file for complete search history.

(56) References Cited

U.S. PATENT DOCUMENTS 9,723,393 B2 8/2017 Nguyen et al.
10,129,626 B1 * 11/2018 Jung ..... H02J 7/342
(Continued)

FOREIGN PATENT DOCUMENTS

CN 102149032 A 8/2011
CN 104580614 A 4/2015
(Continued)

*Primary Examiner* — Jason R Kurr
(74) *Attorney, Agent, or Firm* — LKGlobal | Lorenz & Kopf, LLP

(57) ABSTRACT

An interactive control method and device of an earphone case, and an earphone case are disclosed. The earphone case includes a first accommodating cavity and a second accommodating cavity. The method includes: acquiring taking-out sequential order information or putting-in sequential order information of a first earphone and/or a second earphone with respect to the first accommodating cavity and/or the second accommodating cavity; determining a corresponding functional instruction of a mobile terminal or a corresponding functional instruction of an earphone according to a preset correspondence between the taking-out sequential order information or the putting-in sequential order information and functional instructions of the mobile terminal or functional instructions of the earphone; and sending the functional instruction of the mobile terminal to the mobile terminal or to the earphone.

18 Claims, 2 Drawing Sheets

(52) U.S. Cl.
CPC ..... *H04R 2201/10* (2013.01); *H04R 2420/07* (2013.01); *H04R 2499/11* (2013.01)

(56) References Cited

U.S. PATENT DOCUMENTS

| | | | | |
|---|---|---|---|---|
| 2015/0031411 | A1 | 1/2015 | Jung et al. | |
| 2016/0073189 | A1* | 3/2016 | Lindén ..... | H02J 7/0044 381/74 |
| 2020/0213705 | A1* | 7/2020 | Ding ..... | H02J 7/0044 |

FOREIGN PATENT DOCUMENTS

| | | | |
|---|---|---|---|
| CN | 106507249 | A | 3/2017 |
| CN | 107809696 | A | 3/2018 |
| CN | 107809697 | A | 3/2018 |
| CN | 107872783 | A | 4/2018 |
| CN | 207518810 | U | 6/2018 |
| CN | 108540891 | A | 9/2018 |
| CN | 108564949 | A | 9/2018 |
| CN | 207926861 | U | 9/2018 |
| CN | 207926901 | U | 9/2018 |
| KR | 20110109468 | A | 10/2011 |

* cited by examiner

S101

Acquiring taking-out sequential order information or putting-in sequential order information of the first earphone and/or the second earphone with respect to the first accommodating cavity and/or the second accommodating cavity

S102

Determining a functional instruction of an mobile terminal corresponding to the taking-out sequential order information or the putting-in sequential order information, or determining a functional instruction of an earphone corresponding to the taking-out sequential order information or the putting-in sequential order information, according to a preset correspondence between the taking-out sequential order information or the putting-in sequential order information and functional instructions of the mobile terminal or functional instructions of the earphone

S103

Sending the functional instruction of the mobile terminal to the mobile terminal, so that the mobile terminal executes the functional instruction of the mobile terminal to realize an interaction function with the earphone, or sending the functional instruction of the earphone to the earphone to realize an interaction function between the earphone case and the earphone

FIG. 1

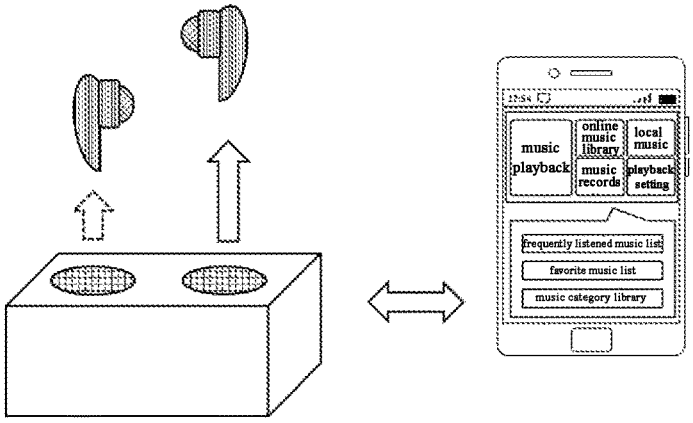

FIG. 2

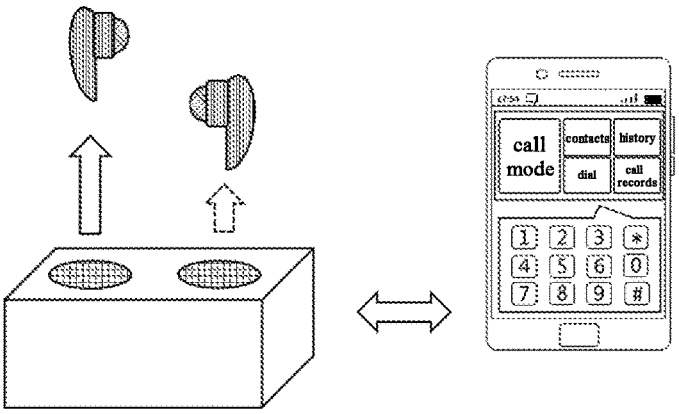

FIG. 3

INTERACTIVE CONTROL METHOD AND DEVICE OF AN EARPHONE CASE, EARPHONE CASE AND STORAGE MEDIUM

CROSS REFERENCE TO RELATED APPLICATIONS

This is a continuation of International Application No. PCT/CN2018/125265 filed on Dec. 29, 2018, which claims the benefit and priority of Chinese Application Nos. 201811270481.2 filed Oct. 29, 2018 and 201811332524.5 filed Nov. 9, 2018. The above applications are hereby incorporated herein by reference in their entirety.

TECHNICAL FIELD

This Application pertains to the technical field of smart devices, in particular to an interactive control method and device of an earphone case, an earphone case and a storage medium.

BACKGROUND

With the rapid development of artificial intelligence, more and more functions can be realized by smart devices, and the user's requirements for function realization are increasingly higher. For example, conventional wireless earphones can interact with a mobile phone, an earphone case, etc., but the interactive control process is relatively complicated, and the user experience needs to be further improved. In addition, other objects, desirable features and characteristics will become apparent from the subsequent summary and detailed description, and the appended claims, taken in conjunction with the accompanying drawings and this background.

SUMMARY

The present disclosure provides an interactive control method and device of an earphone case, an earphone case and a storage medium, which enriches the interactive control mode of the earphone case, increases the degree of intelligence of interaction between the earphone case and the earphone and between the earphone and the mobile terminal, and improves the user experience.

According to an aspect of the present disclosure, there is provided an interactive control method of an earphone case, the earphone case comprises a first accommodating cavity for accommodating a first earphone and a second accommodating cavity for accommodating a second earphone, and the method comprises:

acquiring taking-out sequential order information of taking the first earphone and/or the second earphone out of the first accommodating cavity and/or the second accommodating cavity or putting-in sequential order information of putting the first earphone and/or the second earphone into the first accommodating cavity and/or the second accommodating cavity;

determining a functional instruction of a mobile terminal corresponding to the taking-out sequential order information or the putting-in sequential order information, or determining a functional instruction of an earphone corresponding to the taking-out sequential order information or the putting-in sequential order information, according to a preset correspondence between the taking-out sequential order information or the putting-in sequential order information and functional instructions of the mobile terminal or functional instructions of the earphone; and sending the functional instruction of the mobile terminal to the mobile terminal, so that the mobile terminal executes the functional instruction of the mobile terminal to realize an interaction function with the earphone, or sending the functional instruction of the earphone to the earphone to realize an interaction function between the earphone case and the earphone.

The interactive control method and device of an earphone case according to the embodiments of the present disclosure acquire taking-out sequential order information of taking the first earphone and/or the second earphone out of the first accommodating cavity and/or the second accommodating cavity or putting-in sequential order information of putting the first earphone and/or the second earphone into the first accommodating cavity and/or the second accommodating cavity; determine a functional instruction of a mobile terminal corresponding to the taking-out sequential order information or the putting-in sequential order information, or determine a functional instruction of an earphone corresponding to the taking-out sequential order information or the putting-in sequential order information, according to a preset correspondence between the taking-out sequential order information or the putting-in sequential order information and functional instructions of the mobile terminal or functional instructions of the earphone; and send the functional instruction of the mobile terminal to the mobile terminal, so that the mobile terminal executes the functional instruction of the mobile terminal to realize an interaction function with the earphone, or sending the functional instruction of the earphone to the earphone to realize an interaction function between the earphone case and the earphone. Thus, the user can realize the control of the interaction between the earphone and the mobile terminal and the interaction between the earphone case and the earphone through the earphone case only by taking out the earphone or putting in the earphone according to different sequential orders, which enriches the functions of the earphone case, increases the degree of intelligence and convenience of the interaction control, and improves the user experience.

BRIEF DESCRIPTION OF DRAWINGS

The present invention will hereinafter be described in conjunction with the following drawing figures, wherein like numerals denote like elements, and:

FIG. 1 is a schematic flowchart of an interactive control method of an earphone case according to an embodiment of the present disclosure.

FIG. 2 is a functional schematic diagram of taking earphones one after the other out of an earphone case and corresponding control according to an embodiment of the present disclosure;

FIG. 3 is a functional schematic diagram of taking earphones one after the other out of an earphone case and corresponding control according to another embodiment of the present disclosure;

DETAILED DESCRIPTION

Figure 4:
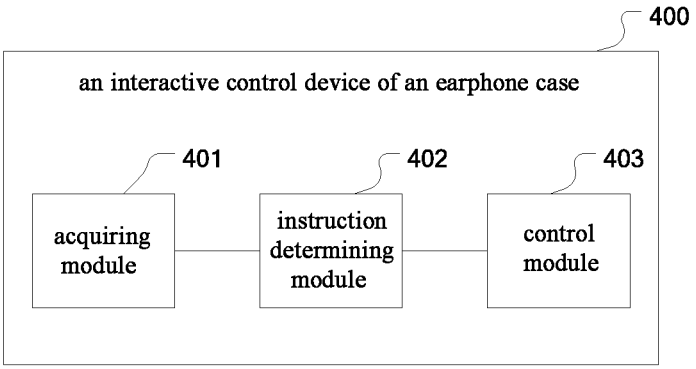
FIG. 4 is a block diagram of an interactive control device of an earphone case according to an embodiment of the present disclosure.

The following detailed description is merely exemplary in nature and is not intended to limit the invention or the application and uses of the invention. Furthermore, there is no intention to be bound by any theory presented in the preceding background of the invention or the following detailed description.

In order to make the objectives, features, and advantages of the present disclosure clearer, the present disclosure will be further described in detail in conjunction with the drawings and specific embodiments. Obviously, the embodiments described are only part of, rather than all of, the embodiments of the present disclosure. Based on the embodiments in the present disclosure, all other embodiments obtained by a person of ordinary skill in the art without paying creative work shall fall within the protection scope of the present disclosure.

FIG. 1 is a schematic flowchart of an interactive control method of an earphone case according to an embodiment of the present disclosure. In the present embodiment, the earphone case includes a first accommodating cavity for accommodating a first earphone and a second accommodating cavity for accommodating a second earphone. Referring to FIG. 1, the method includes the following steps:

Step S101: acquiring taking-out sequential order information of taking the first earphone and/or the second earphone out of the first accommodating cavity and/or the second accommodating cavity or putting-in sequential order information of putting the first earphone and/or the second earphone into the first accommodating cavity and/or the second accommodating cavity;

Step S102: determining a functional instruction of a mobile terminal corresponding to the taking-out sequential order information or the putting-in sequential order information, or determining a functional instruction of an earphone corresponding to the taking-out sequential order information or the putting-in sequential order information, according to a preset correspondence between the taking-out sequential order information or the putting-in sequential order information and functional instructions of the mobile terminal or functional instructions of the earphone; and Step S103: sending the functional instruction of the mobile terminal to the mobile terminal, so that the mobile terminal executes the functional instruction of the mobile terminal to realize an interaction function with the earphone, or sending the functional instruction of the earphone to the earphone to realize an interaction function between the earphone case and the earphone.

As shown in FIG. 1, the interactive control method of an earphone case according to the present embodiment acquires taking-out sequential order information of taking the first earphone and/or the second earphone out of the first accommodating cavity and/or the second accommodating cavity or putting-in sequential order information of putting the first earphone and/or the second earphone into the first accommodating cavity and/or the second accommodating cavity, determines a corresponding functional instruction of an mobile terminal or determines a corresponding functional instruction of an earphone according to the taking-out sequential order information or the putting-in sequential order information, and controls to realize the interaction function between the earphone case and the earphone and between the earphone and the mobile terminal based on the functional instruction of the mobile terminal or the functional instruction of the earphone, thereby enriching the interaction control modes of the earphone case, simplifying the interactive process, making the interaction more convenient and intuitive, and improving the user experience.

In an embodiment of the present disclosure, acquiring taking-out sequential order information of taking the first earphone and/or the second earphone out of the first accommodating cavity and/or the second accommodating cavity or putting-in sequential order information of putting the first earphone and/or the second earphone into the first accommodating cavity and/or the second accommodating cavity includes: acquiring an earphone identifier corresponding to taking-out or putting-in in a process of taking-out or putting-in, and determining the following information according to the earphone identifier: taking-out sequential order information or putting-in sequential order information of the first earphone with respect to the first accommodating cavity; or, taking-out sequential order information or putting-in sequential order information of the second earphone with respect to the second accommodating cavity; or, taking-out sequential order information or putting-in sequential order information of the first earphone with respect to the first accommodating cavity, and taking-out sequential order information or putting-in sequential order information of the second earphone with respect to the second accommodating cavity.

Typically, earphones are used in pairs. In other words, when using the earphones, users usually use the first earphone and the second earphone at the same time, and the first earphone and the second earphone are worn in the left and right ear canals to listen to the sound. Correspondingly, the state of the two accommodating cavities of the earphone case are both empty. However, considering that in actual situations, there may be a situation where a single earphone is used, for example, only the first earphone is used and the second earphone is not used. At this point, the first accommodating cavity for accommodating the first earphone is in an empty state, and the second accommodating cavity for accommodating the second earphone is in an accommodating state (i.e., a state that an earphone is placed therein). In an embodiment of the present disclosure, an earphone identifier corresponding to taking-out or putting-in in a process of taking-out or putting-in is acquired to determine the taking-out sequential order information of taking the first earphone and/or the second earphone out of the first accommodating cavity and/or the second accommodating cavity or putting-in sequential order information of putting the first earphone and/or the second earphone into the first accommodating cavity and/or the second accommodating cavity in three situations, namely, (1) the taking-out sequential order information or putting-in sequential order information of the first earphone with respect to the first accommodating cavity; (2) the taking-out sequential order information or putting-in sequential order information of the second earphone with respect to the second accommodating cavity; (3) taking-out sequential order information or putting-in sequential order information of the first earphone with respect to the first accommodating cavity, and taking-out sequential order information or putting-in sequential order information of the second earphone with respect to the second accommodating cavity.

It should be noted that, the taking-out sequential order information herein includes: sequential order information of taking-out switching electrical signals acquired when a user first takes the first earphone out of the first accommodating cavity and then takes the second earphone out of the second accommodating cavity; the putting-in sequential order information herein includes: sequential order information of putting-in switching electrical signals acquired when a user first puts the first earphone into the first accommodating cavity and then puts the second earphone into the second accommodating cavity.

In an embodiment of the present disclosure, the sequential order information of taking-out switching electrical signals acquired includes: a corresponding taking-out switching electrical signal acquired when the first or second accommodating cavity switches from an accommodating state to an empty state after the user takes the first earphone out of the first accommodating cavity or takes the second earphone out of the second accommodating cavity; the sequential order information of putting-in switching electrical signals acquired includes: a corresponding putting-in switching electrical signal acquired when the first or second accommodating cavity switches from an empty state to an accommodating state after the user puts the first earphone into the first accommodating cavity or puts the second earphone into the second accommodating cavity.

In an embodiment of the present disclosure, each of the first accommodating cavity and the second accommodating cavity of the earphone case is provided therein with a detection sensor. Based on this, acquiring taking-out sequential order information of taking the first earphone out of the first accommodating cavity and taking the second earphone out of the second accommodating cavity includes: acquiring a first taking-out switching electrical signal generated by a first detection sensor on the first accommodating cavity in response to a pressure value change after the user takes the first earphone out of the first accommodating cavity; and acquiring a second taking-out switching electrical signal generated by a second detection sensor on the second accommodating cavity in response to a pressure value change after the user takes the second earphone out of the second accommodating cavity; wherein a resistance value of a built-in resistor of the first detection sensor is different from a resistance value of a built-in resistor of the second detection sensor, and the first taking-out switching electrical signal is acquired before the second taking-out switching electrical signal is acquired.

Acquiring putting-in sequential order information of putting the first earphone into the first accommodating cavity and putting the second earphone into the second accommodating cavity includes: acquiring a first putting-in switching electrical signal generated by a first detection sensor on the first accommodating cavity in response to a pressure value change after the user puts the first earphone into the first accommodating cavity; and acquiring a second putting-in switching electrical signal generated by a second detection sensor on the second accommodating cavity in response to a pressure value change after the user puts the second earphone into the second accommodating cavity; wherein a resistance value of a built-in resistor of the first detection sensor is different from a resistance value of a built-in resistor of the second detection sensor, and the first putting-in switching electrical signal is acquired before the second putting-in switching electrical signal is acquired.

The detection sensor on the accommodating cavity of the earphone case can identify the current state of the accommodating cavity, such as whether it is an empty state or an accommodating state, and can acquire an earphone identifier corresponding to taking-out or putting-in in a process of taking-out or putting-in, for example, according to first current information of a first current passing through the built-in resistor of the first detection sensor, determine an earphone identifier of the first earphone corresponding to the first current information; and according to second current information of a second current passing through the built-in resistor of the second detection sensor, determine an earphone identifier of the second earphone corresponding to the second current information.

Since in reality, the third situation (i.e., using the first earphone and the second earphone at the same time) is the habit of most people, in the following embodiments, the description is given priority to the situation where the information acquired is (3) the taking-out sequential order information or putting-in sequential order information of the first and second earphones with respect to the first and second accommodating cavities.

Referring to FIG. 2, the first earphone is a left earphone, and the second earphone is a right earphone; taking-out sequential order information of the left earphone and the right earphone is acquired, and a first functional instruction of a mobile terminal corresponding to the taking-out sequential order information is determined according to a preset correspondence between the taking-out sequential order information and functional instructions of the mobile terminal; the first functional instruction of the mobile terminal includes at least one of the following functional instructions: a functional instruction instructing to establish a wireless connection between the mobile terminal and the earphones, a functional instruction instructing to run a music application in the mobile terminal, and a functional instruction instructing to play music through the earphones.

As shown in FIG. 2, when the user first takes the left earphone out of the accommodating cavity (the solid arrow indicates being taken out), and then takes the right earphone out of the corresponding accommodating cavity (the dotted arrow indicates having been taken out), the earphone case detects the taking-out sequential order information, and according to a preset correspondence between the taking-out sequential order information and functional instructions of the mobile terminal that has been stored, searches and determines a first functional instruction of the mobile terminal. The earphone case sends the first functional instruction of the mobile terminal to the mobile terminal for execution, thereby realizing an interaction between the mobile terminal and the earphones. Referring to FIG. 2, in the present embodiment, it is schematically illustrated by taking a mobile phone as an example of the mobile terminal, but it is not limited to this, and the mobile terminal may also be a PC or an iPad.

When the user takes the earphones out of the accommodating cavities of the earphone case in a sequential order, the earphone case will control the mobile phone to run the music application on the mobile phone and show the music player homepage. Referring to FIG. 2, the music player homepage displays items such as "frequently listened music list", "music category library", "online music library", and "playback setting". In addition, the functional instructions sent by the earphone case to the mobile phone also include an instruction for establishing a pairing connection between the mobile phone and the earphones (in the present embodiment, the earphones are Bluetooth wireless earphones). In this way, the mobile phone can establish a wireless connection with the earphones according to the instruction and play music on the mobile phone through the earphones.

It can be seen from the above that, the interactive control method of an earphone case according to the embodiment of the present disclosure acquires the operation that the user first takes the left earphone out of a corresponding accommodating cavity and then takes the right earphone out of a corresponding accommodating cavity, and make the this operation of user have a control function, such as controlling the mobile phone to establish a connection with the wireless earphones, controlling the mobile phone to run the music application on the mobile phone, thereby enriching the interactive control modes of the earphone case, increasing the degree of intelligence of the earphone case, improving the interaction process between the user and the earphone case, between the earphone case and the mobile phone, and between the mobile phone and the earphones, and improving the user experience and satisfaction.

Referring to FIG. 3, in another embodiment of the present disclosure, the first earphone may also be a right earphone, and the second earphone may also be a left earphone. The taking-out sequential order information of the right earphone and the left earphone is acquired, and a second functional instruction of the mobile terminal corresponding to the taking-out sequential order information is determined according to a preset correspondence between the taking-out sequential order information and functional instructions of the mobile terminal; the second functional instruction of the mobile terminal includes at least one of the following functional instructions: a functional instruction instructing the mobile terminal to turn on a call mode, a functional instruction instructing the mobile terminal to show a dial interface to receive a phone number input by a user, or a functional instruction instructing the mobile terminal to answer an incoming call through the earphones.

As shown in FIG. 3, when the user has taken the right earphone out of the accommodating cavity and continued to take the left earphone out of the accommodating cavity, the earphone case detects this taking-out sequential order information that the right earphone first is taken out before the left earphone, and according to this taking-out sequential order information detected and a preset correspondence between the taking-out sequential order information and a second functional instruction of the mobile terminal, searches and determines the second functional instruction of the mobile terminal. The earphone case sends the second functional instruction of the mobile terminal to the mobile terminal (such as a mobile phone). The mobile phone receives and then executes the second functional instruction of the mobile terminal, thereby realizing the interaction between the mobile phone and the earphones, for example, turning on the call mode of the mobile phone, displaying the dialing interface including the dial on the mobile phone, and answering calls or making calls through earphones, etc. Compared with the conventional method of answering or making mobile phone calls through earphones, it simplifies operations such as manually opening the dial of the mobile phone after putting on the earphones, and achieves the beneficial effect of automatically controlling to show the dial of the mobile phone or automatically answering calls through earphones according to the sequential order of taking the left and right earphones out of the earphone case and putting on them, and meets the needs of users.

Similar to the above taking-out process, for the case of putting the earphones into the accommodating cavities of the earphone case, in an embodiment of the present disclosure, when the first earphone is a left earphone, and the second earphone is a right earphone, the putting-in sequential order information of the left earphone and the right earphone is acquired, and a third functional instruction of the mobile terminal corresponding to the putting-in sequential order information is determined according to a preset correspondence between the putting-in sequential order information and functional instructions of the mobile terminal; the third functional instruction of the mobile terminal includes at least one of the following functional instructions: a functional instruction instructing to pause a music application in the mobile terminal, a functional instruction instructing to stop a music application in the mobile terminal, a functional instruction instructing to play music through a speaker in the mobile terminal, or a functional instruction instructing the mobile terminal to turn off a wireless connection with the earphones.

In other words, when the user first puts the left earphone into a corresponding accommodating cavity of the earphone case, and then puts the right earphone into a corresponding accommodating cavity of the earphone case, the earphone case detects this putting-in sequential order information and controls the mobile terminal to execute the third functional instruction of the mobile terminal to implement preset functions, such as pausing the music application in the mobile terminal, stopping the music application in the mobile terminal, playing music through the speaker in the mobile terminal, and turning off the wireless connection between the mobile phone and the earphones.

Similarly, when the first earphone is the right earphone and the second earphone is the left earphone, the putting-in sequential order information of the right earphone and the left earphone is acquired, and a fourth functional instruction corresponding to the putting-in sequential order information is determined according to a preset correspondence between the putting-in sequential order information and functional instructions of the mobile terminal; the fourth functional instruction of the mobile terminal includes at least one of the following functional instructions: a functional instruction instructing to play a call voice through a speaker in the mobile terminal, a functional instruction instructing the mobile terminal to turn off a wireless connection with the earphones, or a functional instruction instructing the mobile terminal to hang up.

In practical applications, when the user first puts the right earphone into the second accommodating cavity of the earphone case, and then puts the left earphone into the first accommodating cavity of the earphone case, the earphone case detects this putting-in sequential order and determines the fourth functional instruction of the mobile terminals according to the putting-in sequential order and sent it to the mobile phone for execution, to control the mobile phone to realize the interaction with the earphones. Herein the fourth functional instruction of the mobile terminal include: a functional instruction instructing to play a call voice through a speaker in the mobile terminal, a functional instruction instructing the mobile terminal to turn off a wireless connection with the earphones, or a functional instruction instructing the mobile terminal to hang up.

As a result, the degree of intelligence of the interactive control of the earphone case and the mobile phone is greatly improved, the needs of users are met, and the competitiveness of the product is improved.

In an embodiment of the present disclosure, for the case of using a single earphone, the method includes: when the earphone identifier indicates that there is only information of the first earphone, according to taking-out information when the first earphone is taken out of the first accommodating cavity or putting-in information when the first earphone is put in the first accommodating cavity, and a preset correspondence between the taking-out information or the putting-in information and functional instructions of the mobile terminal, determining a fifth functional instruction of the mobile terminal corresponding to the taking-out sequential order information or a sixth functional instruction of the mobile terminal corresponding to the putting-in sequential order information; sending the fifth functional instruction of the mobile terminal or the sixth functional instruction of the mobile terminal to the mobile terminal, so that the mobile terminal executes the fifth functional instruction of the mobile terminal or the sixth functional instruction of the mobile terminal to realize a fifth interaction function or a sixth interaction function with the earphone.

In a specific application, if the user only uses the first earphone and does not use the second earphone, the earphone case of the present embodiment determines whether the first earphone is the left earphone or the right earphone according to the earphone identifier acquired, and according to a preset correspondence between the information about taking out the left earphone (or, the right earphone) alone and functional instructions of the mobile phone that has been stored, determine the fifth functional instruction of the mobile terminal; or, according to the information about putting in the left earphone (or, the right earphone) alone, determine the corresponding sixth functional instruction of the mobile terminal. The determined fifth or sixth functional instruction of the mobile terminal is sent to the mobile phone for execution, so as to control the mobile phone to realize the interaction with the earphone.

For example, in an embodiment, the first earphone is a left earphone; the fifth functional instruction of the mobile terminal corresponding to the taking-out information is determined according to a preset correspondence between the taking-out information of the left earphone and functional instructions of the mobile terminal; the fifth functional instruction of the mobile terminal includes at least one of the following functional instructions: a functional instruction instructing to establish a wireless connection with the earphone, a functional instruction instructing to run a music application in the mobile terminal, or a functional instruction instructing to show a frequently listened music playlist of the user in the music application and play music through the earphone.

Alternatively, the first earphone is a left earphone; the sixth functional instruction of the mobile terminal corresponding to the putting-in information is determined according to a preset correspondence between the putting-in information of the left earphone and the functional instructions of the mobile terminal; the sixth functional instruction of the mobile terminal includes at least one of the following functional instructions: a functional instruction instructing to pause a music application in the mobile terminal, a functional instruction instructing to stop a music application in the mobile terminal, a functional instruction instructing to play music through a speaker in the mobile terminal, or a functional instruction instructing to turn off a wireless connection with the earphone.

In another embodiment of the present disclosure, the first earphone is a right earphone; the fifth functional instruction of the mobile terminal corresponding to the taking-out information is determined according to a preset correspondence between the taking-out information of the right earphone and functional instructions of the mobile terminal; the fifth functional instruction of the mobile terminal includes at least one of the following functional instructions: a functional instruction instructing the mobile terminal to turn on a call mode, a functional instruction instructing the mobile terminal to show a dial interface to receive a phone number input by a user, or a functional instruction instructing the mobile terminal to answer an incoming call through the earphone. Alternatively, the first earphone is a right earphone; the sixth functional instruction of the mobile terminal corresponding to the putting-in information is determined according to a preset correspondence between the putting-in information of the right earphone and the functional instructions of the mobile terminal; the sixth functional instruction of the mobile terminal includes at least one of the following functional instructions: a functional instruction instructing to play a call voice through a speaker in the mobile terminal, a functional instruction instructing to turn off a connection with the earphone, or a functional instruction instructing the mobile terminal to hang up.

The above describes the interactive control method of an earphone case according to the embodiment of the present disclosure, in which the interaction between the mobile terminal (such as a mobile phone) and the earphone is controlled based on the sequential order information of taking-out or putting-in of the first earphone and/or the second earphone with respect to the first accommodating cavity and/or the second accommodating cavity. Additionally the interactive control method of an earphone case according to the embodiment of the present disclosure can also controls the interaction between the earphone case and the earphone based on the sequential order information of taking-out or putting-in of the first earphone and/or the second earphone with respect to the first accommodating cavity and/or the second accommodating cavity.

In a specific embodiment, the first earphone is a left earphone, and the second earphone is a right earphone; taking-out sequential order information of the left earphone and the right earphone is acquired, and a first functional instruction of the earphones corresponding to the taking-out sequential order information is determined according to a preset correspondence between the taking-out sequential order information and functional instructions of the earphones; the first functional instruction of the earphones includes a functional instruction instructing the earphone to turn off a charging mode or an instruction instructing the earphones to initiate a pairing connection request.

Alternatively, the first earphone is a right earphone, and the second earphone is a left earphone; taking-out sequential order information of the right earphone and the left earphone is acquired, and a second functional instruction of the earphones corresponding to the taking-out sequential order information is determined according to a preset correspondence between the taking-out sequential order information and functional instructions of the earphones; the second functional instruction of the earphones includes a functional instruction instructing the earphones to enter a standby play mode.

It should be noted that, in the embodiment of the present disclosure, the earphone case is provided therein with a charging module. On this basis, when the earphone case acquires a taking-out sequential order information of the left and right earphones (i.e., first the left earphone, and then the right earphone) through the detection sensors in the accommodating cavities, the earphone case controls the internal charging module to stop working and at the same time sends a first functional instruction to the earphones to control the earphones to turn off the charging mode of the earphones. Moreover, the earphone case can also send a first functional instruction to the earphones to control the earphones to initiate a pairing connection request to pair with an external mobile terminal. When the earphone case acquires a taking-out sequential order information of the right and left earphones (i.e., first the right earphone, and then the left earphone) through the detection sensors in the accommodating cavities, the earphone case sends a second functional instruction to the earphones to control the earphones to enter the standby play mode and prepare to play sounds.

Similarly, in another embodiment, the first earphone is a left earphone, and the second earphone is a right earphone; the earphone case acquires putting-in sequential order information of the left earphone and the right earphone, and determines a third functional instruction of the earphones corresponding to the putting-in sequential order information according to a preset correspondence between the putting-in sequential order information and functional instructions of the earphones; the third functional instruction of the earphones includes at least one of the following functional instructions: a functional instruction instructing the earphones to disconnect from the mobile terminal, a functional instruction instructing the earphones to stop playing sounds, and a functional instruction instructing the earphones to enter a low power mode.

Alternatively, in an embodiment, the first earphone is a right earphone, and the second earphone is a left earphone; putting-in sequential order information of the right earphone and the left earphone is acquired, and a fourth functional instruction of the earphones corresponding to the putting-in sequential order information is determined according to a preset correspondence between the putting-in sequential order information and functional instructions of the earphones; the fourth functional instruction of the earphones includes a functional instruction instructing the earphones to enter a charging mode.

In other words, when the earphone case detects the putting-in sequential order information of the left and right earphones (i.e., first the left earphone, and then the right earphone), a third earphone functional instruction is sent to the earphones for execution to realize the effects that the earphones are disconnected from the mobile terminal, the earphones stop playing sounds, and the earphones enter the low power mode. When the earphone case detects the putting-in sequential order information of the right and left earphones (i.e., first the right earphone, and then the left earphone), a fourth earphone functional instruction is sent to the earphones for execution to realize the effect that the earphones enter the charging mode.

The implementation steps of the above interactive control method of an earphone case will be described as follows with reference to a specific application scenario.

In this application scenario, the hardware includes: an earphone case, a pair of wireless earphones that matches with and can be accommodated in the earphone case, and built-in detectors in the earphone accommodating cavities of the earphone case that are used to detect whether the earphones are taken out of or put in the earphone accommodating cavities of the earphone case. For example, the detectors can be pressure sensors with different resistance values, and after the left and right earphones are put in the accommodating cavities the pressures generated are different. The left and right earphones are assigned with different identifiers, such as 1 for the left earphone and 2 for the right earphone.

Take the left earphone as an example. When the left earphone is put in, the pressure sensor on the left earphone accommodating cavity outputs a 0-1 switching of electrical signals; when the left earphone is taken out, the pressure sensor outputs a 1-0 switching of electrical signals. In other words, when the earphone is put in, the pressure sensor detects a value of 1; when the earphone is taken out, the pressure sensor detects a value of 0. Moreover, the pressure sensor records the time for switching the value, and if the time is within a specified time, it indicates that the state of the accommodating cavity has changed. It should be emphasized that the output of the pressure sensor is a 0-1 switching or a 1-0 switching, that is a change of value rather than a fixed value (such as 0, 1). By outputting the switching of signals, the accuracy of the state detection is improved, and it is ensured that the interactive control can be implemented correctly.

For the right earphone, the accommodating cavity for accommodating the right earphone is also provided thereon with a pressure sensor. Since the pressure sensor has a different resistance value from the pressure sensor on the accommodating cavity for accommodating the left earphone, the current values of the currents passing through them must also be different. Based on this, it is can be distinguished the state of which earphone it is based on the magnitude of the current value. Different from the electrical signal output by the left earphone above, when the right earphone is put in, the pressure sensor on the right earphone accommodating cavity outputs a 0-2 switching of electric signals; when the right earphone is taken out, the pressure sensor outputs a 2-0 switching of electric signals.

By setting in advance that the first detection sensor on the left earphone accommodating cavity outputs a 1-0 or 0-1 switching, and the second detection sensor on the right earphone accommodating cavity outputs a of 2-0 or 0-2 switching, the combinations and output of these four switching signals within a preset time can indicate corresponding states. For example, if within 5 seconds, the first detection sensor outputs a 0-1 switching, and the second detection sensor outputs a 0-2 switching, it indicates that the user puts in the left earphone first, and then puts in the right earphone. When the first detection sensor outputs a 1-0 switching and the second detection sensor outputs a 2-0 switching within 5 seconds, it indicates the user first takes out the left earphone, and then takes out the right earphone.

In this application scenario, the earphone case can realize charging and interaction with the earphones or the mobile phone. When the user first puts the left earphone into the earphone case, and then puts the right earphone into the earphone case, the earphone case sends instructions to the mobile phone and earphones, controls to stop the music playback of the mobile phone and at the same time cut off the wireless connection between the mobile phone and the earphones, and the left and right earphones enter a power saving mode. When the user first puts the right earphone into the earphone case, and then puts the left earphone into the earphone case, the earphone case sends instructions to the mobile phone and earphones, controls to turn on the mobile phone speakers to continue playing music and at the same time cut off the wireless connection between the mobile phone and the earphones, and the left and right earphones enter a power saving mode.

When the user first takes the left earphone out of the earphone case and then takes the right earphone out of the earphone case, the earphone case sends instructions to the mobile phone and earphones, controls the mobile phone to run the music playback function, and controls the left and right earphones to connect to the mobile phone for music playback. When the user first takes the right earphone out of the earphone case, and then takes the left earphone out of the earphone case, the earphone case sends instructions to the mobile phone and the earphone, controls the mobile phone to turn on the call mode, and the left and right earphones to connect to the mobile phone to play the call.

Based on the same inventive concept as the above interactive control method of an earphone case, an embodiment of the present disclosure provides an interactive control device of an earphone case. Referring to FIG. 4, the earphone case includes a first accommodating cavity for accommodating a first earphone and a second accommodating cavity for accommodating a second earphone. The interactive control device 400 of an earphone case includes:

an acquiring module 401 for acquiring taking-out sequential order information of taking the first earphone and/or the second earphone out of the first accommodating cavity and/or the second accommodating cavity or putting-in sequential order information of putting the first earphone and/or the second earphone into the first accommodating cavity and/or the second accommodating cavity;

an instruction determining module 402 for determining a functional instruction of a mobile terminal corresponding to the taking-out sequential order information or the putting-in sequential order information, or determining a functional instruction of an earphone corresponding to the taking-out sequential order information or the putting-in sequential order information, according to a preset correspondence between the taking-out sequential order information or the putting-in sequential order information and functional instructions of the mobile terminal or functional instructions of the earphone; and a control module 403 for sending the functional instruction of the mobile terminal to the mobile terminal, so that the mobile terminal executes the functional instruction of the mobile terminal to realize an interaction function with the earphone, or sending the functional instruction of the earphone to the earphone to realize an interaction function between the earphone case and the earphone.

In an embodiment of the present disclosure, the acquiring module 401 is specifically for acquiring an earphone identifier corresponding to taking-out or putting-in in a process of taking-out or putting-in, and determining the following information according to the earphone identifier: taking-out or putting-in sequential order information of the first earphone with respect to the first accommodating cavity; or, taking-out or putting-in sequential order information of the second earphone with respect to the second accommodating cavity; or, taking-out or putting-in sequential order information of the first earphone with respect to the first accommodating cavity, and taking-out or putting-in sequential order information of the second earphone with respect to the second accommodating cavity.

In an embodiment of the present disclosure, the taking-out sequential order information acquired by the acquiring module 401 includes: sequential order information of taking-out switching electrical signals acquired when a user first takes the first earphone out of the first accommodating cavity and then takes the second earphone out of the second accommodating cavity; the putting-in sequential order information includes: sequential order information of putting-in switching electrical signals acquired when a user first puts the first earphone into the first accommodating cavity and then puts the second earphone into the second accommodating cavity.

Figure 5:
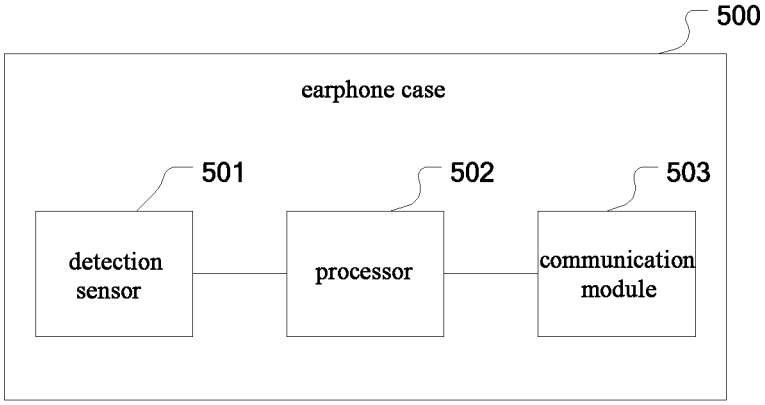
FIG. 5 is a block diagram of an earphone case according to an embodiment of the present disclosure.

Referring to FIG. 5, an embodiment of the present disclosure also provides an earphone case 500, including: a first accommodating cavity for accommodating a first earphone and a second accommodating cavity for accommodating a second earphone, wherein each of the first accommodating cavity and the second accommodating cavity is provided thereon with a detection sensor 501 that is connected to a processor 502;

the detection sensor 501 is for acquiring taking-out sequential order information or putting-in sequential order information of the first earphone and/or the second earphone with respect to the first accommodating cavity and/or the second accommodating cavity, and sending it to the processor;

the processor 502 is for determining a functional instruction of the mobile terminal corresponding to the taking-out sequential order information or the putting-in sequential order information, or determining a functional instruction of the earphone corresponding to the taking-out sequential order information or the putting-in sequential order information, according to a preset correspondence between the taking-out sequential order information or the putting-in sequential order information and functional instructions of the mobile terminal or functional instructions of the earphone; and the earphone case further includes a communication module 503 for sending the functional instruction of the mobile terminal to the mobile terminal, so that the mobile terminal executes the functional instruction of the mobile terminal to realize an interaction function with the earphone, or sending the functional instruction of the earphone to the earphone to realize an interaction function between the earphone case and the earphone.

In an embodiment of the present disclosure, an interactive control method of earphones is provided, the earphones match with the earphone case in the above earphone case embodiments. The interactive control method of earphones is applied to the earphones and includes:

acquiring taking-out sequential order information or putting-in sequential order information of the first earphone and/or the second earphone with respect to the first accommodating cavity and/or the second accommodating cavity of the earphone case;

determining a functional instruction of the mobile terminal corresponding to the taking-out sequential order information or the putting-in sequential order information, or determining a functional instruction of the earphone case corresponding to the taking-out sequential order information or the putting-in sequential order information, according to a preset correspondence between the taking-out sequential order information or the putting-in sequential order information and functional instructions of the mobile terminal or functional instructions of the earphone case; and sending the functional instruction of the mobile terminal to the mobile terminal, so that the mobile terminal executes the functional instruction of the mobile terminal to realize an interaction function with the earphone, or sending the functional instruction of the earphone case to the earphone case to realize an interaction function between the earphone case and the earphone.

In an embodiment of the present disclosure, acquiring taking-out sequential order information or putting-in sequential order information of the first earphone and/or the second earphone with respect to the first accommodating cavity and/or the second accommodating cavity of the earphone case includes:

acquiring an accommodating cavity identifier corresponding to taking-out or putting-in in a process of taking-out or putting-in, and determining, according to the accommodating cavity identifier, taking-out or putting-in sequential order information of the first earphone with respect to the first accommodating cavity; or, acquiring taking-out or putting-in sequential order information of the second earphone with respect to the second accommodating cavity; or, acquiring taking-out or putting-in sequential order information of the first earphone and the second earphone with respect to the first accommodating cavity and the second accommodating cavity.

In an embodiment of the present disclosure, acquiring taking-out sequential order information of taking the first earphone out of the first accommodating cavity and taking the second earphone out of the second accommodating cavity includes:

acquiring a first taking-out switching electrical signal generated by a first detection sensor on the first accommodating cavity in response to a pressure value change after the user takes the first earphone out of the first accommodating cavity; and acquiring a second taking-out switching electrical signal generated by a second detection sensor on the second accommodating cavity in response to a pressure value change after the user takes the second earphone out of the second accommodating cavity;

wherein a resistance value of a built-in resistor of the first detection sensor is different from a resistance value of a built-in resistor of the second detection sensor, and the first taking-out switching electrical signal is acquired before the second taking-out switching electrical signal is acquired;

acquiring putting-in sequential order information of putting the first earphone into the first accommodating cavity and putting the second earphone into the second accommodating cavity includes:

acquiring a first putting-in switching electrical signal generated by a first detection sensor on the first accommodating cavity in response to a pressure value change after the user puts the first earphone into the first accommodating cavity; and acquiring a second putting-in switching electrical signal generated by a second detection sensor on the second accommodating cavity in response to a pressure value change after the user puts the second earphone into the second accommodating cavity;

wherein a resistance value of a built-in resistor of the first detection sensor is different from a resistance value of a built-in resistor of the second detection sensor, and the first putting-in switching electrical signal is acquired before the second putting-in switching electrical signal is acquired.

In an embodiment of the present disclosure, acquiring an accommodating cavity identifier corresponding to taking-out or putting-in in a process of taking-out or putting-in includes:

according to first current information of a first current passing through the built-in resistor of the first detection sensor, determining an accommodating cavity identifier of the first accommodating cavity corresponding to the first current information; and according to second current information of a second current passing through the built-in resistor of the second detection sensor, determining an accommodating cavity identifier of the second accommodating cavity corresponding to the second current information.

It should be noted that, unlike the interactive control method of an earphone case described above, in the interactive control method of earphones of the present embodiment, the earphone is provided with thereon a detection sensor, the earphone acquires an accommodating cavity identifier corresponding to taking-out or putting-in in a process of taking-out or putting-in according to the first current information of a first current passing through the built-in resistor of the first detection sensor or according to the second current information of a second current passing through the built-in resistor of the second detection sensor, and determines the taking-out or the putting-in sequential order information of the first earphone and/or the second earphone with respect to the first accommodating cavity and/or the second accommodating cavity of the earphone case according to the accommodating cavity identifier; and then the interaction between the earphone and the earphone case and between the earphone and the mobile terminal is controlled according to the taking-out sequential order information or the putting-in sequential order information, thereby enriching the interactive control modes of the earphones and enhances the competitiveness of the earphones.

Figure 6:
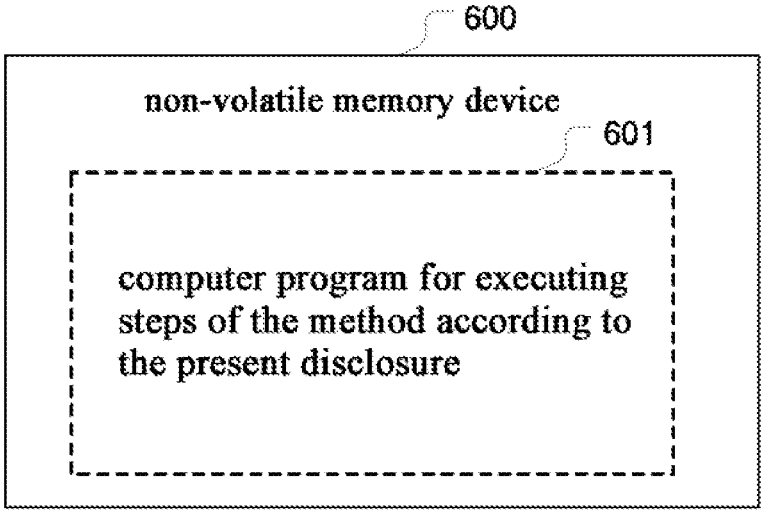
FIG. 6 is a block diagram of a computer storage medium according to an embodiment of the present disclosure.

Another embodiment of the present disclosure provides a non-volatile memory device 600. Referring to FIG. 6, the non-volatile memory device 600 has a computer program (i.e., the computer program 601 for executing steps of the method according to the present disclosure in FIG. 6) stored thereon. When the computer program 601 is executed by a processor, the steps of the above interactive control method of an earphone case are implemented. Based on such understanding, the substantial part or the part that contributes to the prior art or a part of the technical solutions of the present disclosure may be embodied in the form of a software product, the computer software product may be stored in one storage medium, and include several instructions for causing a computer device (which may be a personal computer, a server, or a network device) to perform all or part of the steps of the methods described in the various embodiments of the present disclosure. The storage medium includes various mediums capable of storing program codes, such as a USB flash disk, a mobile hard disk, a read-only memory (ROM), a random access memory (RAM), a magnetic disk, or an optical disk.

A person skilled in the art should understand that the embodiments of the present disclosure may be provided as a method, a system, or a computer program product. Thus, the present disclosure may take the form of an all-in-hardware embodiment, an all-in-software embodiment, or an embodiment combining software and hardware. Furthermore, the present disclosure may take the form of a computer program product embodied on one or more non-volatile memory device having computer-usable program codes recorded thereon.

The present disclosure is described with reference to flowcharts and/or block diagrams of the method, the device (system), and the computer program product according to the embodiment of the present disclosure. It should be understood that each flow and/or block in the flowcharts and/or block diagrams, and combinations of the flows and/or blocks in the flowcharts and/or block diagrams may be implemented by computer program instructions. The computer program instructions may be provided to a processor of a general purpose computer, a special purpose computer, an embedded processor, or other programmable data processing device to generate a machine so that a device for implementing the functions specified in one or more flows of a flowchart or and/or one or more blocks of a block diagram can be generated by instructions executed by a processor of a computer or other programmable data processing device.

It should be noted that the terms "comprise", "include" or any other variations thereof are non-exclusive or open-ended, so that a process, method, article, or device including a series of elements includes not only those elements listed but also includes unspecified elements as well as elements that are inherent to such a process, method, article, or device. In the case that there is no more limitation, the phrase "comprising a . . . " does not exclude that the process, method, article, or device including the named element further includes additional named element.

In the description of the present disclosure, many specific details are illustrated. However, it can be understood that embodiments of the present disclosure may be practiced without these specific details. In some instances, well-known methods, structures and techniques have not been shown in detail in order not to obscure the understanding of this description. Similarly, it should be understood that in order to simplify the disclosure of the present disclosure and help understand one or more of the various inventive aspects, in the above description of exemplary embodiments of the present disclosure, various features of the present disclosure are sometimes grouped together in a single embodiment, diagrams, or description thereof. However, the disclosed method should not be interpreted as reflecting an intention that the claimed present disclosure requires more features than those expressly recited in each claim. More exactly, as the following claims reflect, inventive aspects include features less than all features of a single foregoing disclosed embodiment. Thus, the claims following the detailed description are hereby expressly incorporated into this detailed description, with each claim being an independent embodiment of the present disclosure.

The description above is merely embodiments of the present disclosure. With the foregoing teachings of the present disclosure, a person skilled in the art may make other improvements or modifications based on the foregoing embodiments. A person skilled in the art should understand that the specific description above is only for better explaining the present disclosure, and the protection scope of the present disclosure should be subject to the protection scope of the claims.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. An interactive control method of an earphone case, wherein the earphone case comprises a first accommodating cavity for accommodating a first earphone and a second accommodating cavity for accommodating a second earphone, and the method comprises:

acquiring taking-out sequential order information or putting-in sequential order information of the first earphone and/or the second earphone with respect to the first accommodating cavity and/or the second accommodating cavity;

determining a functional instruction of a mobile terminal corresponding to the taking-out sequential order information or the putting-in sequential order information, or determining a functional instruction of an earphone corresponding to the taking-out sequential order information or the putting-in sequential order information, according to a preset correspondence between the taking-out sequential order information or the putting-in sequential order information and functional instructions of the mobile terminal or functional instructions of the earphone; and sending the functional instruction of the mobile terminal to the mobile terminal, so that the mobile terminal executes the functional instruction of the mobile terminal to realize an interaction function with the earphone, or sending the functional instruction of the earphone to the earphone to realize an interaction function between the earphone case and the earphone.

2. The method according to claim 1, wherein the taking-out sequential order information includes: sequential order information of taking-out switching electrical signals acquired when a user first takes the first earphone out of the first accommodating cavity and then takes the second earphone out of the second accommodating cavity; and the putting-in sequential order information includes: sequential order information of putting-in switching electrical signals acquired when a user first puts the first earphone into the first accommodating cavity and then puts the second earphone into the second accommodating cavity.

3. The method according to claim 2, wherein the sequential order information of taking-out switching electrical signals acquired includes: a corresponding taking-out switching electrical signal acquired when the first or second accommodating cavity switches from an accommodating state to an empty state after the user takes the first earphone out of the first accommodating cavity or takes the second earphone out of the second accommodating cavity;

the sequential order information of putting-in switching electrical signals acquired includes: a corresponding putting-in switching electrical signal acquired when the first or second accommodating cavity switches from an empty state to an accommodating state after the user puts the first earphone into the first accommodating cavity or puts the second earphone into the second accommodating cavity.

4. The method according to claim 1, wherein acquiring taking-out sequential order information or putting-in sequential order information of the first earphone and/or the second earphone with respect to the first accommodating cavity and/or the second accommodating cavity comprises:

acquiring an earphone identifier corresponding to taking-out or putting-in in a process of taking-out or putting-in, and determining the following information according to the earphone identifier: taking-out sequential order information or putting-in sequential order information of the first earphone with respect to the first accommodating cavity; or, taking-out sequential order information or putting-in sequential order information of the second earphone with respect to the second accommodating cavity; or, taking-out sequential order information or putting-in sequential order information of the first earphone and the second earphone with respect to the first accommodating cavity and the second accommodating cavity.

5. The method according to claim 4, wherein the first earphone is a left earphone, and the second earphone is a right earphone; taking-out sequential order information of the left earphone and the right earphone is acquired, and a first functional instruction of the mobile terminal corresponding to the taking-out sequential order information is determined according to a preset correspondence between the taking-out sequential order information and functional instructions of the mobile terminal; the first functional instruction of the mobile terminal includes at least one of the following functional instructions: a functional instruction instructing to establish a wireless connection between the mobile terminal and the earphones, a functional instruction instructing to run a music application in the mobile terminal, and a functional instruction instructing to play music through the earphones; or, the first earphone is a right earphone, and the second earphone is a left earphone; taking-out sequential order information of the right earphone and the left earphone is acquired, and a second functional instruction of the mobile terminal corresponding to the taking-out sequential order information is determined according to a preset correspondence between the taking-out sequential order information and functional instructions of the mobile terminal; the second functional instruction of the mobile terminal includes at least one of the following functional instructions: a functional instruction instructing the mobile terminal to turn on a call mode, a functional instruction instructing the mobile terminal to show a dial interface to receive a phone number input by a user, or a functional instruction instructing the mobile terminal to answer an incoming call through the earphones.

6. The method according to claim 4, wherein the first earphone is a left earphone, and the second earphone is a right earphone; putting-in sequential order information of the left earphone and the right earphone is acquired, and a third functional instruction of the mobile terminal corresponding to the putting-in sequential order information is determined according to a preset correspondence between the putting-in sequential order information and functional instructions of the mobile terminal; the third functional instruction of the mobile terminal includes at least one of the following functional instructions: a functional instruction instructing to pause a music application in the mobile terminal, a functional instruction instructing to stop a music application in the mobile terminal, a functional instruction instructing to play music through a speaker in the mobile terminal, or a functional instruction instructing the mobile terminal to turn off a wireless connection with the earphone; or, the first earphone is a right earphone, and the second earphone is a left earphone; putting-in sequential order information of the right earphone and the left earphone is acquired, and a fourth functional instruction of the mobile terminal corresponding to the putting-in sequential order information is determined according to a preset correspondence between the putting-in sequential order information and functional instructions of the mobile terminal; the fourth functional instruction of the mobile terminal includes at least one of the following functional instructions: a functional instruction instructing to play a call voice through a speaker in the mobile terminal, a functional instruction instructing the mobile terminal to turn off a wireless connection with the earphones, or a functional instruction instructing the mobile terminal to hang up.

7. The method according to claim 4, wherein acquiring taking-out sequential order information of taking the first earphone out of the first accommodating cavity and taking the second earphone out of the second accommodating cavity comprises:

acquiring a first taking-out switching electrical signal generated by a first detection sensor on the first accommodating cavity in response to a pressure value change after a user takes the first earphone out of the first accommodating cavity; and acquiring a second taking-out switching electrical signal generated by a second detection sensor on the second accommodating cavity in response to a pressure value change after the user takes the second earphone out of the second accommodating cavity;

wherein a resistance value of a built-in resistor of the first detection sensor is different from a resistance value of a built-in resistor of the second detection sensor, and the first taking-out switching electrical signal is acquired before the second taking-out switching electrical signal is acquired;

acquiring putting-in sequential order information of putting the first earphone into the first accommodating cavity and putting the second earphone into the second accommodating cavity comprises:

acquiring a first putting-in switching electrical signal generated by a first detection sensor on the first accommodating cavity in response to a pressure value change after the user puts the first earphone into the first accommodating cavity; and acquiring a second putting-in switching electrical signal generated by a second detection sensor on the second accommodating cavity in response to a pressure value change after the user puts the second earphone into the second accommodating cavity;

wherein a resistance value of a built-in resistor of the first detection sensor is different from a resistance value of a built-in resistor of the second detection sensor, and the first putting-in switching electrical signal is acquired before the second putting-in switching electrical signal is acquired.

8. The method according to claim 7, wherein acquiring an earphone identifier corresponding to taking-out or putting-in in a process of taking-out or putting-in comprises:

according to first current information of a first current passing through the built-in resistor of the first detection sensor, determining an earphone identifier of the first earphone corresponding to the first current information; and according to second current information of a second current passing through the built-in resistor of the second detection sensor, determining an earphone identifier of the second earphone corresponding to the second current information.

9. The method according to claim 8, wherein the method further comprises:

when the earphone identifier indicates that there is only information of the first earphone, determining a fifth functional instruction of the mobile terminal corresponding to the taking-out sequential order information or a sixth functional instruction of the mobile terminal corresponding to the putting-in sequential order information according to taking-out information when the first earphone is taken out of the first accommodating cavity or putting-in information when the first earphone is put in the first accommodating cavity, and a preset correspondence between the taking-out information or the putting-in information and functional instructions of the mobile terminal;

sending the fifth functional instruction of the mobile terminal or the sixth functional instruction of the mobile terminal to the mobile terminal, so that the mobile terminal executes the fifth functional instruction of the mobile terminal or the sixth functional instruction of the mobile terminal to realize a fifth interaction function or a sixth interaction function with the earphone.

10. The method according to claim 9, wherein the first earphone is a left earphone; the fifth functional instruction of the mobile terminal corresponding to the taking-out information is determined according to a preset correspondence between the taking-out information of the left earphone and functional instructions of the mobile terminal; the fifth functional instruction of the mobile terminal includes at least one of the following functional instructions: a functional instruction instructing to establish a wireless connection with the earphone, a functional instruction instructing to run a music application in the mobile terminal, or a functional instruction instructing to show a frequently listened music playlist of the user in the music application and play music through the earphone; or, the first earphone is a left earphone; the sixth functional instruction of the mobile terminal corresponding to the putting-in information is determined according to a preset correspondence between the putting-in information of the left earphone and the functional instructions of the mobile terminal; the sixth functional instruction of the mobile terminal includes at least one of the following functional instructions: a functional instruction instructing to pause a music application in the mobile terminal, a functional instruction instructing to stop a music application in the mobile terminal, a functional instruction instructing to play music through a speaker in the mobile terminal, or a functional instruction instructing to turn off a wireless connection with the earphone.

11. The method according to claim 9, wherein the first earphone is a right earphone; the fifth functional instruction of the mobile terminal corresponding to the taking-out information is determined according to a preset correspondence between the taking-out information of the right earphone and functional instructions of the mobile terminal; the fifth functional instruction of the mobile terminal includes at least one of the following functional instructions: a functional instruction instructing the mobile terminal to turn on a call mode, a functional instruction instructing the mobile terminal to show a dial interface to receive a phone number input by the user, or a functional instruction instructing the mobile terminal to answer an incoming call through the earphone; or, the first earphone is a right earphone; the sixth functional instruction of the mobile terminal corresponding to the putting-in information is determined according to a preset correspondence between the putting-in information of the right earphone and the functional instructions of the mobile terminal; the sixth functional instruction of the mobile terminal includes at least one of the following functional instructions: a functional instruction instructing to play a call voice through a speaker in the mobile terminal, a functional instruction instructing to turn off a connection with the earphone, or a functional instruction instructing the mobile terminal to hang up.

12. The method according to claim 4, wherein the first earphone is a left earphone, and the second earphone is a right earphone; taking-out sequential order information of the left earphone and the right earphone is acquired, and a first functional instruction of the earphones corresponding to the taking-out sequential order information is determined according to a preset correspondence between the taking-out sequential order information and functional instructions of the earphones; the first functional instruction of the earphones includes a functional instruction instructing the earphones to turn off a charging mode or an instruction instructing the earphones to initiate a pairing connection request; or, the first earphone is a right earphone, and the second earphone is a left earphone; taking-out sequential order information of the right earphone and the left earphone is acquired, and a second functional instruction of the earphones corresponding to the taking-out sequential order information is determined according to a preset correspondence between the taking-out sequential order information and functional instructions of the earphones; the second functional instruction of the earphones includes a functional instruction instructing the earphones to enter a standby play mode.

13. The method according to claim 4, wherein the first earphone is a left earphone, and the second earphone is a right earphone; putting-in sequential order information of the left earphone and the right earphone is acquired, and a third functional instruction of the earphones corresponding to the putting-in sequential order information is determined according to a preset correspondence between the putting-in sequential order information and functional instructions of the earphones; the third functional instruction of the earphones includes at least one of the following functional instructions: a functional instruction instructing the earphones to turn off the connection with the mobile terminal, a functional instruction instructing the earphone to stop playing sounds, or a functional instruction instructing the earphones to enter a low power mode; or, the first earphone is a right earphone, and the second earphone is a left earphone; putting-in sequential order information of the right earphone and the left earphone is acquired, and a fourth functional instruction of the earphones corresponding to the putting-in sequential order information is determined according to a preset correspondence between the putting-in sequential order information and functional instructions of the earphones; the fourth functional instruction of the earphones includes a functional instruction instructing the earphones to enter a charging mode.

14. An interactive control method of earphones, wherein the interactive control method of earphones is applied to the earphones, and the method includes:

acquiring taking-out sequential order information or putting-in sequential order information of a first earphone and/or a second earphone with respect to a first accommodating cavity and/or a second accommodating cavity of an earphone case;

determining a functional instruction of a mobile terminal corresponding to the taking-out sequential order information or the putting-in sequential order information, or determining a functional instruction of the earphone case corresponding to the taking-out sequential order information or the putting-in sequential order information, according to a preset correspondence between the taking-out sequential order information or the putting-in sequential order information and functional instructions of the mobile terminal or functional instructions of the earphone case; and sending the functional instruction of the mobile terminal to the mobile terminal, so that the mobile terminal executes the functional instruction of the mobile terminal to realize an interaction function with the earphone, or sending the functional instruction of the earphone case to the earphone case to realize an interaction function between the earphone case and the earphone.

15. The method according to claim 14, wherein acquiring taking-out sequential order information or putting-in sequential order information of the first earphone and/or the second earphone with respect to the first accommodating cavity and/or the second accommodating cavity of the earphone case includes:

acquiring an earphone identifier corresponding to taking-out or putting-in in a process of taking-out or putting-in, and determining the following information according to the earphone identifier: taking-out sequential order information or putting-in sequential order information of the first earphone with respect to the first accommodating cavity; or, taking-out sequential order information or putting-in sequential order information of the second earphone with respect to the second accommodating cavity; or, taking-out sequential order information or putting-in sequential order information of the first earphone and the second earphone with respect to the first accommodating cavity and the second accommodating cavity.

16. The method according to claim 15, wherein acquiring taking-out sequential order information of taking the first earphone out of the first accommodating cavity and taking the second earphone out of the second accommodating cavity includes:

acquiring a first taking-out switching electrical signal generated by a first detection sensor on the first accommodating cavity in response to a pressure value change after a user takes the first earphone out of the first accommodating cavity; and acquiring a second taking-out switching electrical signal generated by a second detection sensor on the second accommodating cavity in response to a pressure value change after the user takes the second earphone out of the second accommodating cavity;

wherein a resistance value of a built-in resistor of the first detection sensor is different from a resistance value of a built-in resistor of the second detection sensor, and the first taking-out switching electrical signal is acquired before the second taking-out switching electrical signal is acquired;

acquiring putting-in sequential order information of putting the first earphone into the first accommodating cavity and putting the second earphone into the second accommodating cavity include:

acquiring a first putting-in switching electrical signal generated by a first detection sensor on the first accommodating cavity in response to a pressure value change after the user puts the first earphone into the first accommodating cavity; and acquiring a second putting-in switching electrical signal generated by a second detection sensor on the second accommodating cavity in response to a pressure value change after the user puts the second earphone into the second accommodating cavity;

wherein a resistance value of a built-in resistor of the first detection sensor is different from a resistance value of a built-in resistor of the second detection sensor, and the first putting-in switching electrical signal is acquired before the second putting-in switching electrical signal is acquired.

17. The method according to claim 16, wherein acquiring an accommodating cavity identifier corresponding to taking-out or putting-in in a process of taking-out or putting-in includes:

according to first current information of a first current passing through the built-in resistor of the first detection sensor, determining an accommodating cavity identifier of the first accommodating cavity corresponding to the first current information; and according to second current information of a second current passing through the built-in resistor of the second detection sensor, determining an accommodating cavity identifier of the second accommodating cavity corresponding to the second current information.

18. A non-volatile memory device, having a computer program stored thereon, wherein when the computer program is executed by a processor, an interactive control method of an earphone case is implemented, wherein the earphone case comprises a first accommodating cavity for accommodating a first earphone and a second accommodating cavity for accommodating a second earphone, and the method includes:

acquiring taking-out sequential order information or putting-in sequential order information of the first earphone and/or the second earphone with respect to the first accommodating cavity and/or the second accommodating cavity;

determining a functional instruction of a mobile terminal corresponding to the taking-out sequential order information or the putting-in sequential order information, or determining a functional instruction of an earphone corresponding to the taking-out sequential order information or the putting-in sequential order information, according to a preset correspondence between the taking-out sequential order information or the putting-in sequential order information and functional instructions of the mobile terminal or functional instructions of the earphone; and sending the functional instruction of the mobile terminal to the mobile terminal, so that the mobile terminal executes the functional instruction of the mobile terminal to realize an interaction function with the earphone, or sending the functional instruction of the earphone to the earphone to realize an interaction function between the earphone case and the earphone.

* * * * *